US006021628A

United States Patent [19]

Jostler et al.

[11] Patent Number: 6,021,628

[45] Date of Patent: Feb. 8, 2000

[54] WEB FOR PACKAGE BLANKS

[75] Inventors: Jan Jostler; Ingemar Broden, both of Halmstad, Sweden

[73] Assignee: Joker Systems Aktiebolag, Halmstad, Sweden

[21] Appl. No.: 09/051,097

[22] PCT Filed: Oct. 3, 1996

[86] PCT No.: PCT/SE96/01247

§ 371 Date: Apr. 1, 1998

§ 102(e) Date: Apr. 1, 1998

[87] PCT Pub. No.: WO97/12816

PCT Pub. Date: Apr. 10, 1997

[30] Foreign Application Priority Data

Oct. 5, 1995 [SE] Sweden ..... 9503451

[51] Int. Cl.[7] ..... B65D 33/14

[52] U.S. Cl. ..... 53/469; 53/133.4; 53/139.2; 53/459

[58] Field of Search ..... 53/133.4, 139.2, 53/383, 459, 467, 469

[56] References Cited

U.S. PATENT DOCUMENTS

| | | | |
|---|---|---|---|
| 3,599,388 | 8/1971 | Feingold | 53/29 |
| 3,813,845 | 6/1974 | Weikert | 53/37 |
| 4,514,962 | 5/1985 | Ausnit | 53/457 |
| 4,558,556 | 12/1985 | Jostler | 53/459 |
| 4,630,311 | 12/1986 | Benton | 383/37 |
| 4,654,878 | 3/1987 | Lems | 383/37 |
| 4,665,552 | 5/1987 | Lems et al. | 383/37 |
| 4,832,505 | 5/1989 | Ausnit et al. | 383/5 |
| 4,945,714 | 8/1990 | Bodolay et al. | 53/568 |
| 5,337,539 | 8/1994 | Barton | 53/413 |
| 5,519,982 | 5/1996 | Herber et al. | 53/412 |
| 5,733,045 | 3/1998 | Jostler et al. | 383/37 |
| 5,814,382 | 9/1998 | Yannuzzi, Jr. | 428/34.3 |

FOREIGN PATENT DOCUMENTS

| | | |
|---|---|---|
| 8200129 | 1/1982 | WIPO . |
| 9425365 | 11/1994 | WIPO . |

*Primary Examiner*—Joseph J. Hail, III
*Assistant Examiner*—William Hong
*Attorney, Agent, or Firm*—Ladas & Parry

[57] ABSTRACT

The invention relates to a web (20) comprising mutually sequentially disposed package blanks (26) and an arrangement for opening and closing the package blanks. The web has longitudinal first and second edges and a first wall (21*a*) opposite a second wall (21*b*). Transverse slits (27) are disposed at the side closures of the package blanks. Each respective wall along the second edge is provided with retainers which guide edge portions of the web when the web is displaced along mechanical devices. The walls (21*a, b*) of each package blank are provided with a longitudinal slit (29*a*). The slit (29*a*) in the first wall extends from the slit (27) at one side closure of the package blank, and the slit in the second wall extends from the slit at the second side closure of the package blank. The mechanical devices are disposed in spaced apart relationship from one another in that part of the apparatus where the package blanks are displaced in the opened state and adjacent to one another when the blanks are displaced in the closed state. Guides (35*a, b;* 36*a, b*) displace the edge portions (24*a, b*) of the web (20) in relation to one another when the package blanks are opened or closed.

10 Claims, 8 Drawing Sheets

WEB FOR PACKAGE BLANKS

FIELD OF THE INVENTION

The present invention relates to a web comprising mutually sequentially arranged package blanks (pockets) which are successively opened and filled with material and then closed.

BACKGROUND

There are needs in the art for a web comprising mutually sequentially disposed pockets in which the web is disposed to be moved along mechanical retainer devices which, during a part of the displacement, hold the pockets in the opened position in order to make it possible to supply material into the pockets, whereafter the retainer devices, on continued movement of the web, hold the pockets in a position in which closure of the pockets takes place.

Patent specification EP-B1 0 054 564 describes a web of the above-indicated type. The web displays two opposing walls and longitudinal first (lower) and second (upper) edges. The web comprises mutually sequentially disposed pockets, with a bottom portion at the first edge and two connecting zones which are transverse in relation to the longitudinal direction of the web and which form side closures of the pockets. Transverse slits are provided between the connecting zones in two adjacent pockets in order to separate the pockets from one another.

The web according to EP-B1 0 054 564 includes two substantially opposing strip portions which extend in the longitudinal direction of the web at its above-mentioned second edge. Each strip portion is provided with a continuous retainer device for cooperation with mechanical guide means for holding the strip portions in spaced apart relationship from one another and thereby holding the pockets in opened position in connection with material being supplied into the pockets. In both walls, the web is provided with slits disposed in the longitudinal direction of the web, the slits for each wall being symmetrically located on either side of the transverse slits.

In purely practical terms, it has proved that the walls of the web in the web described in EP-B1 0 054 564, on movement along the mechanical retainer devices, show a tendency to undesirable displacement in relation to one another in the longitudinal direction of the web. When such mutually displaced walls are moved to positions adjacent to one another for closure of the pockets, creases are readily formed in those regions where the closure is to take place. Such crease formations generally entail that an unacceptable closure is formed on fusion of the strip walls. A further drawback inherent in the prior art web is that the edges located transversely of the longitudinal direction of the web often form undesirable inward or outward bulges in the opened pockets. Such inward and outward bulges lead to problems in the supply of material into the pockets, for which reason correction must be made of the shape of the openings using mechanical devices which are introduced down into the openings and move the edges to positions in which filling and closure of the pockets are not jeopardized.

SUMMARY OF THE INVENTION

The present invention relates to a web and an apparatus for supplying contents to package blanks included in the web, in which the above-drawbacks have been obviated. This is attained by providing each of the first and second walls of each package blank with one respective longitudinal slit, the slit in the first wall being located adjacent to one side closure of the package blank, the slit in the second wall being located adjacent to the second side closure of the package blank.

BRIEF DESCRIPTION OF THE DRAWINGS

The present invention will now be described in greater detail herein-below, with particular reference to the accompanying Drawings, in which:

Figure 1B:
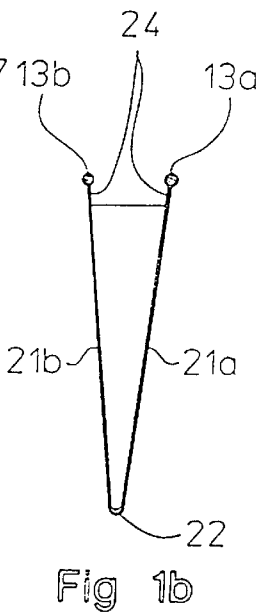
Figure 1:
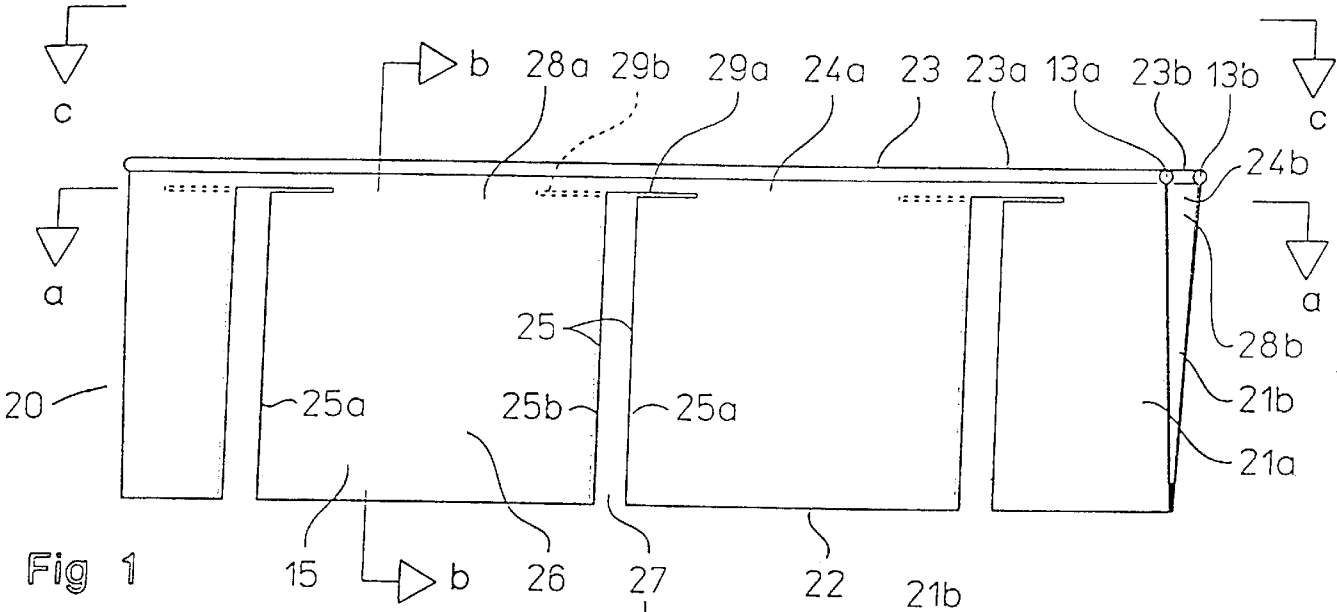
Figure 1A:
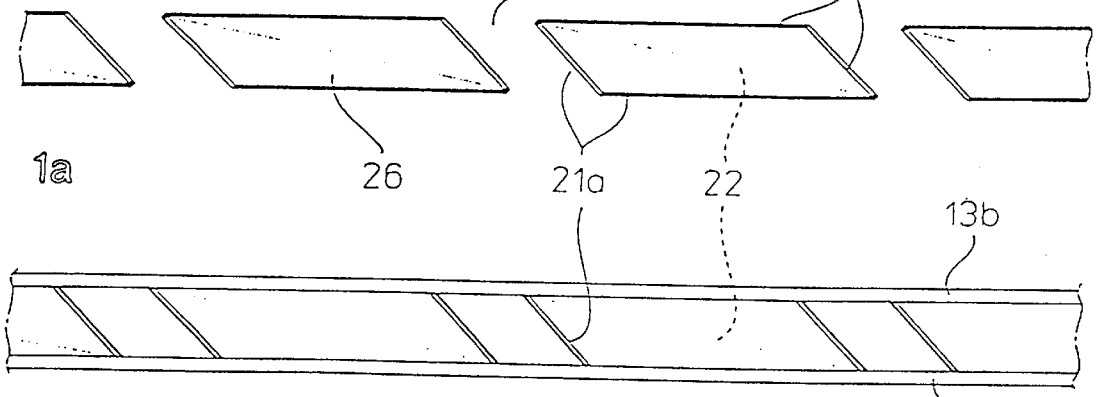
Figure 1C:
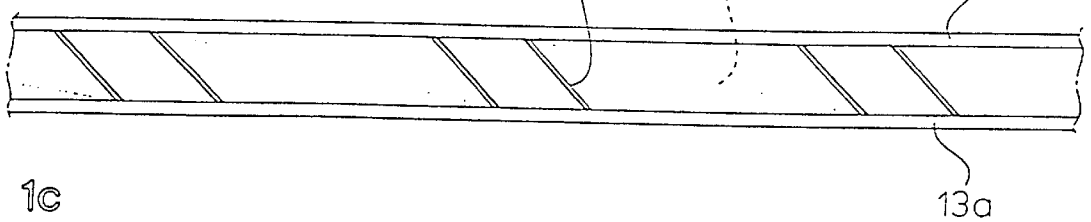
Figures 2, 2A, 2B, 2C:
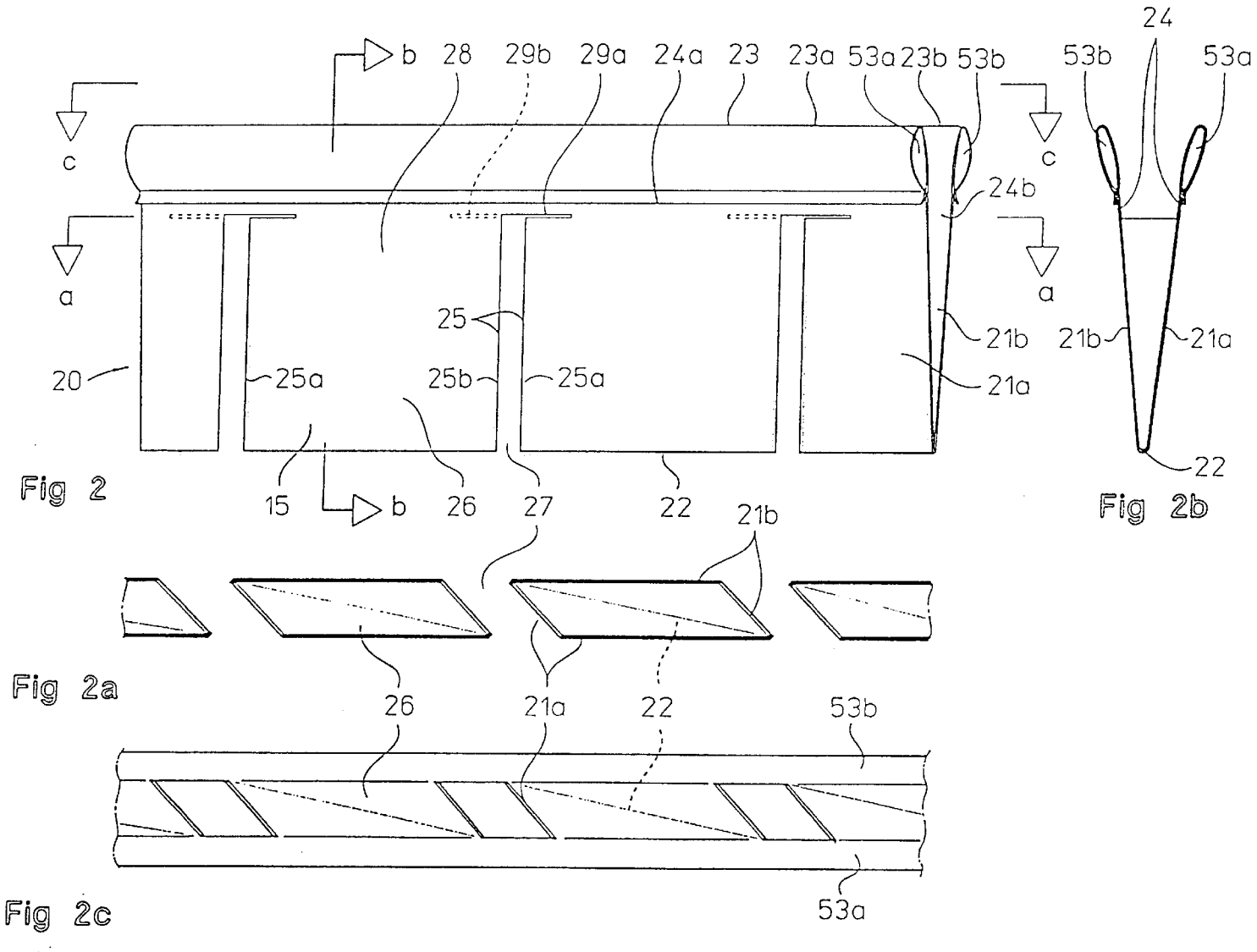
Figures 3A, 3B, 3C:
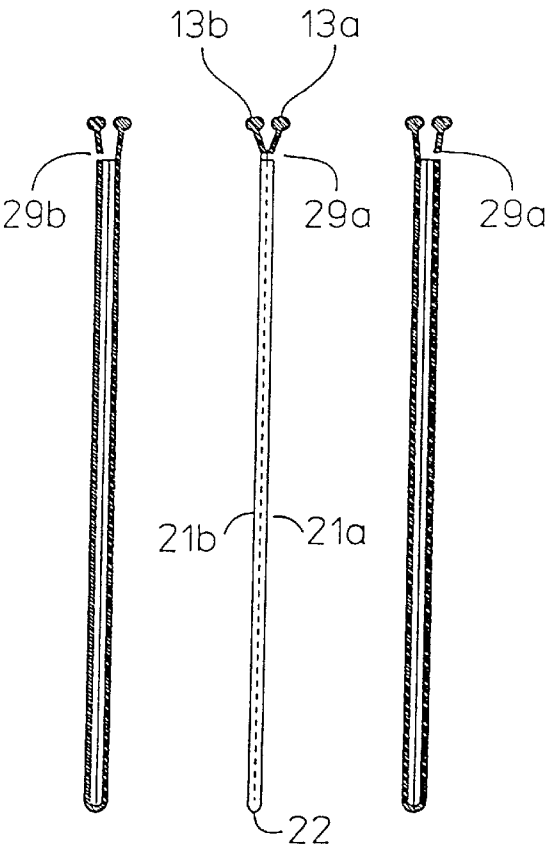
Figure 3:
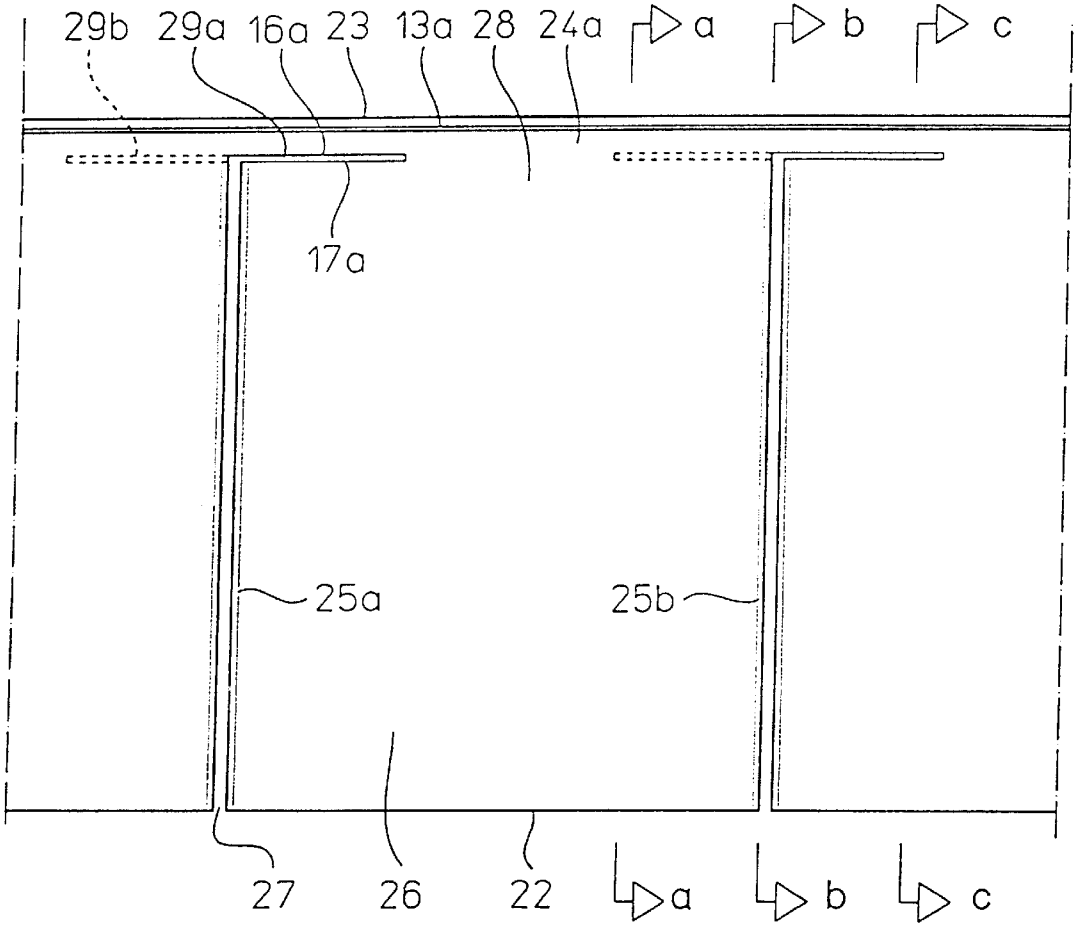
Figures 4A, 4B, 4C:
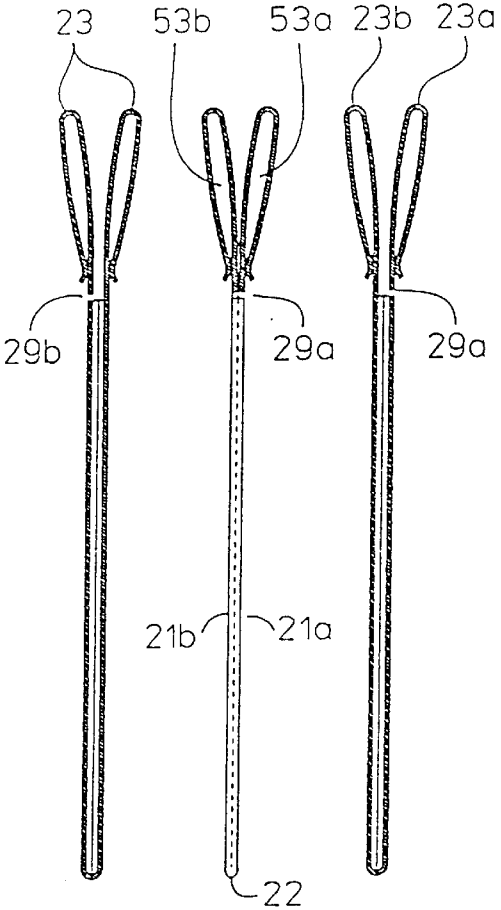
Figure 4:
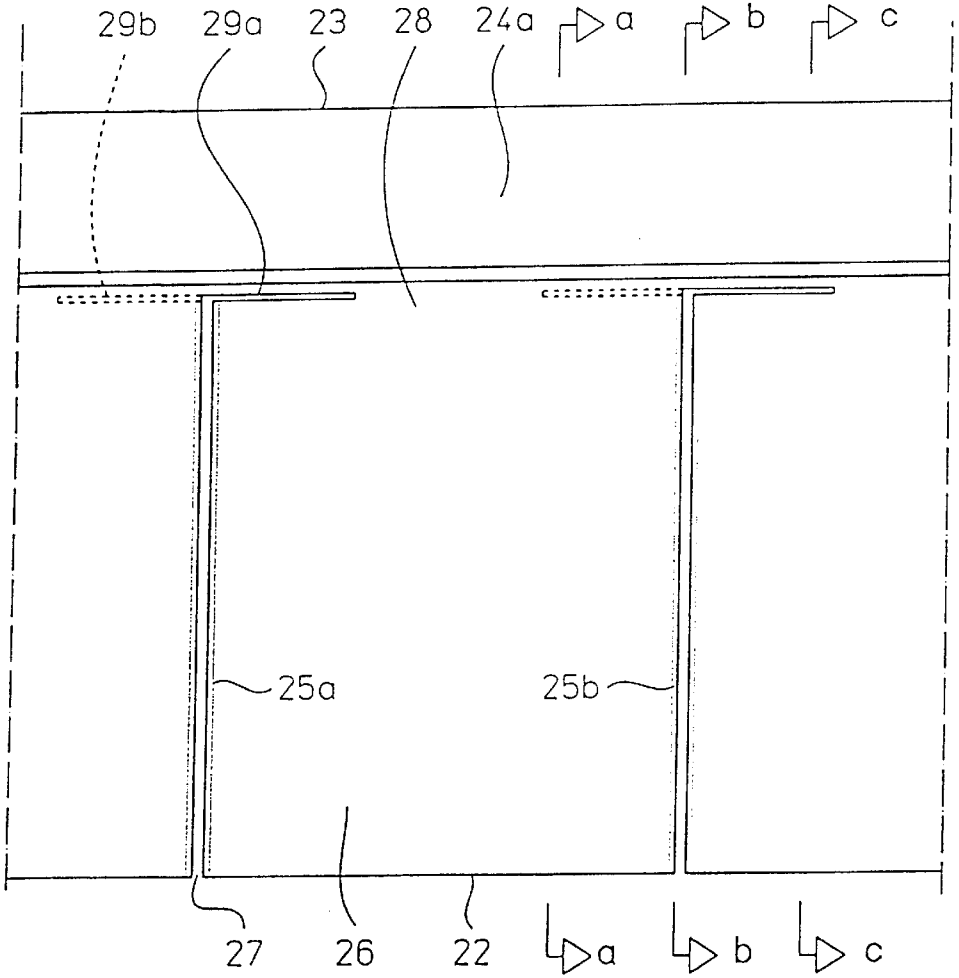
Figure 5B:
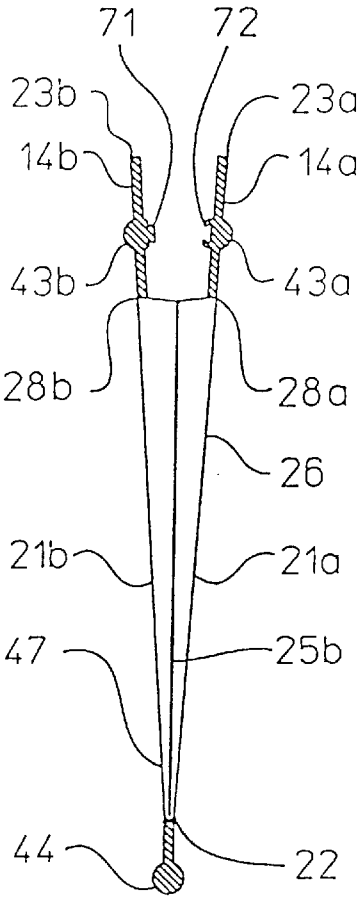
Figure 5A:
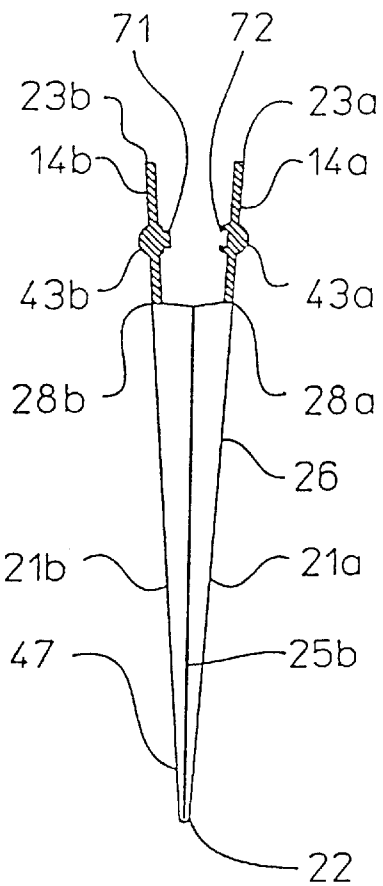
Figure 5C:
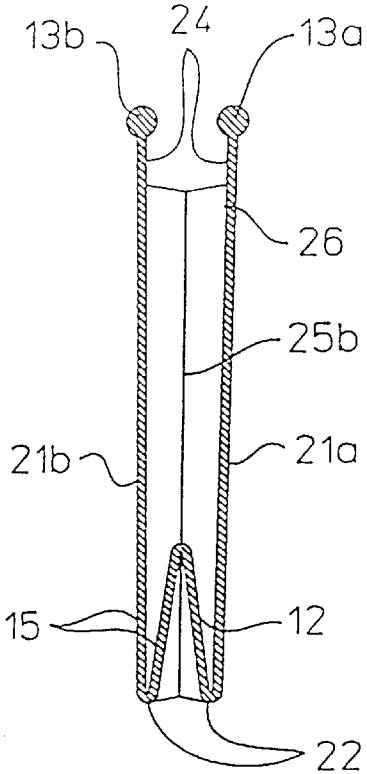
Figure 6:
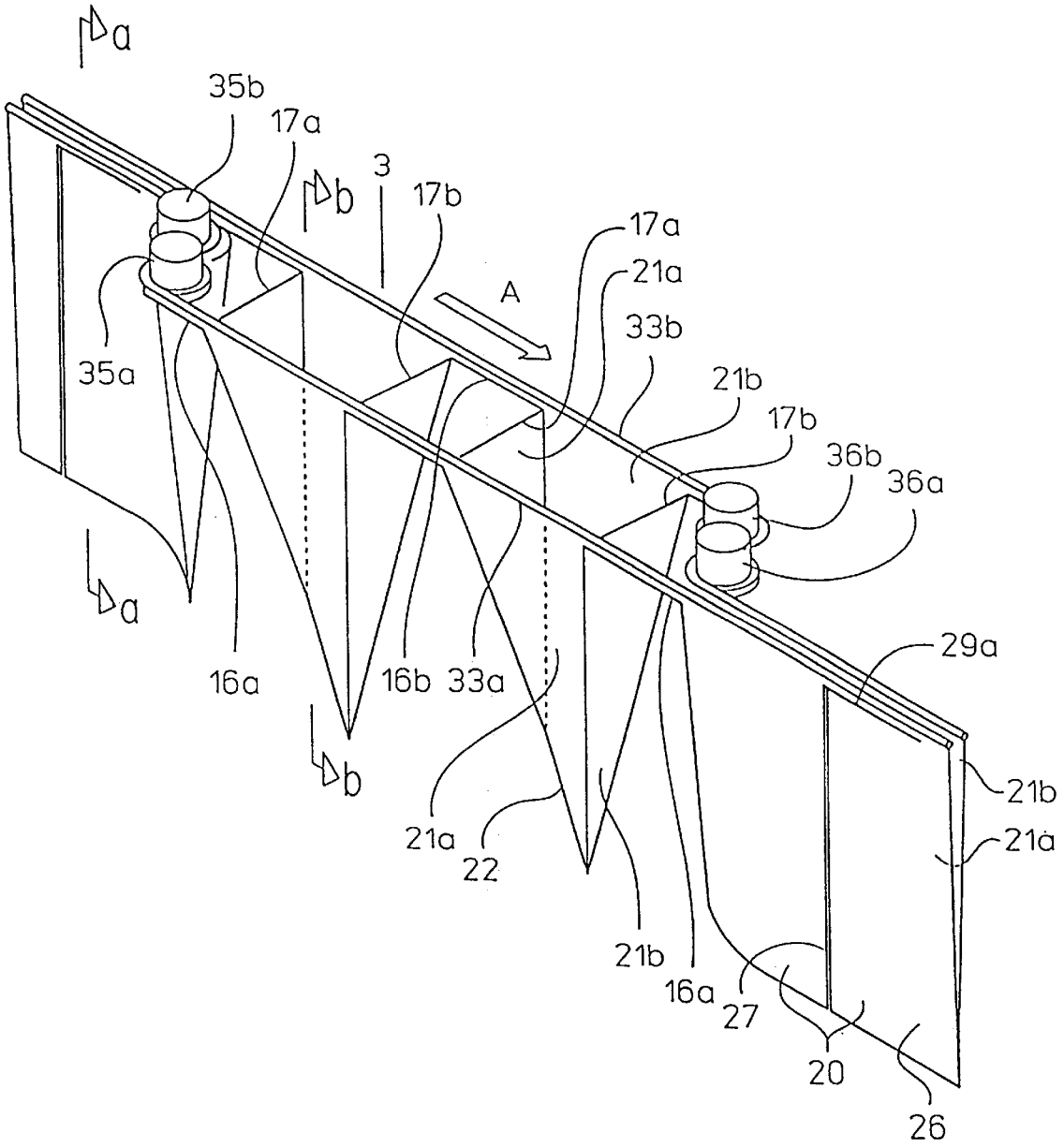
Figure 6B:
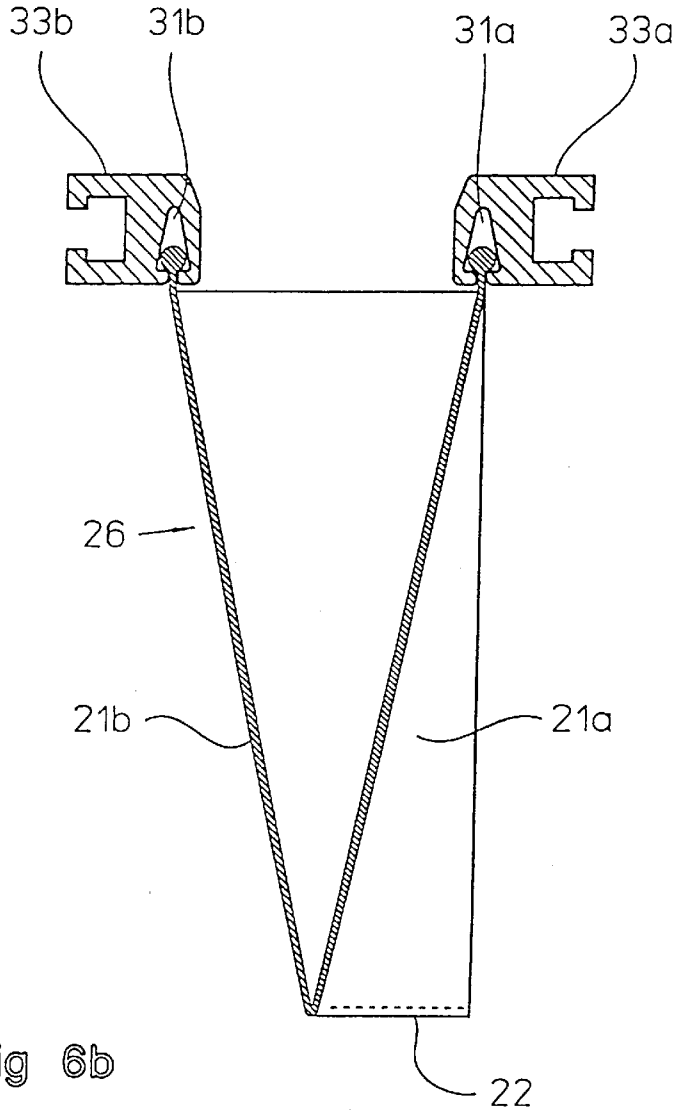
Figure 6A:
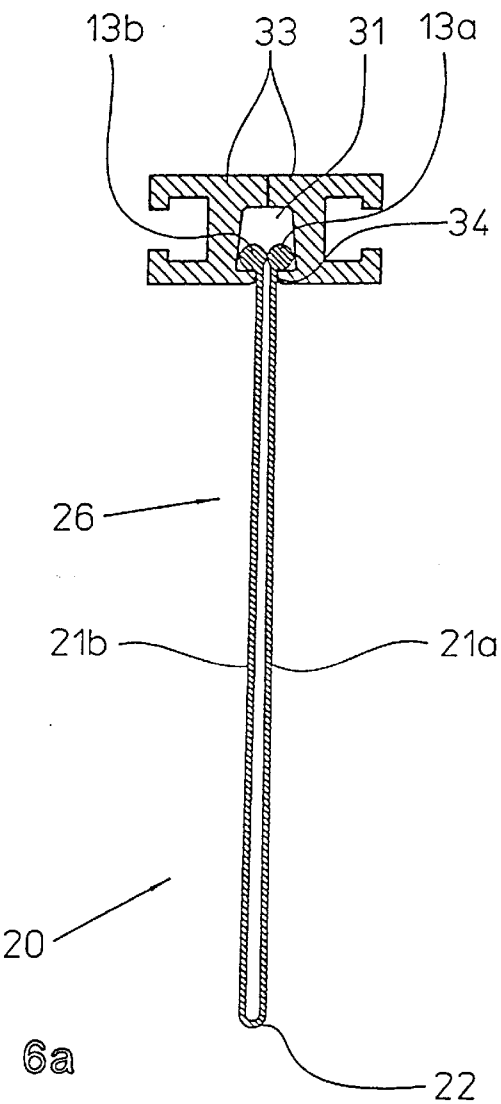
Figure 7:
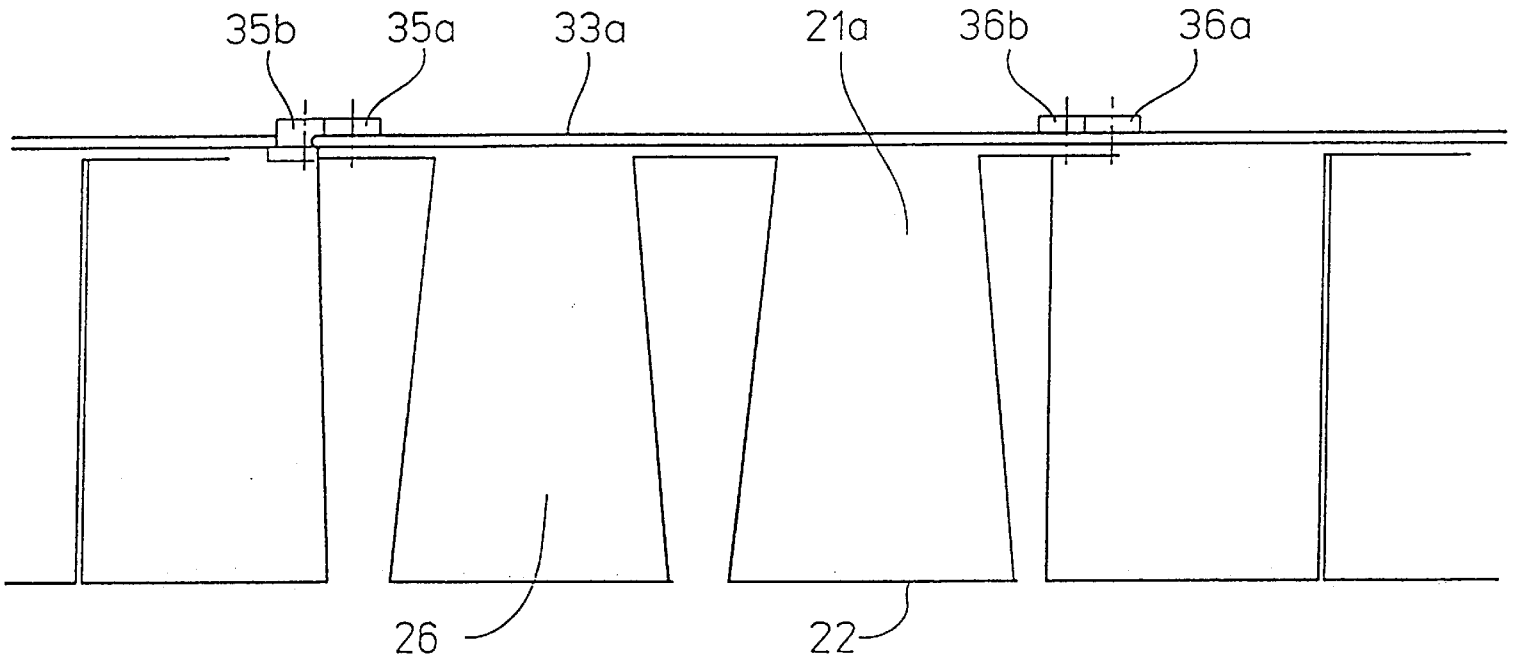
Figure 8:
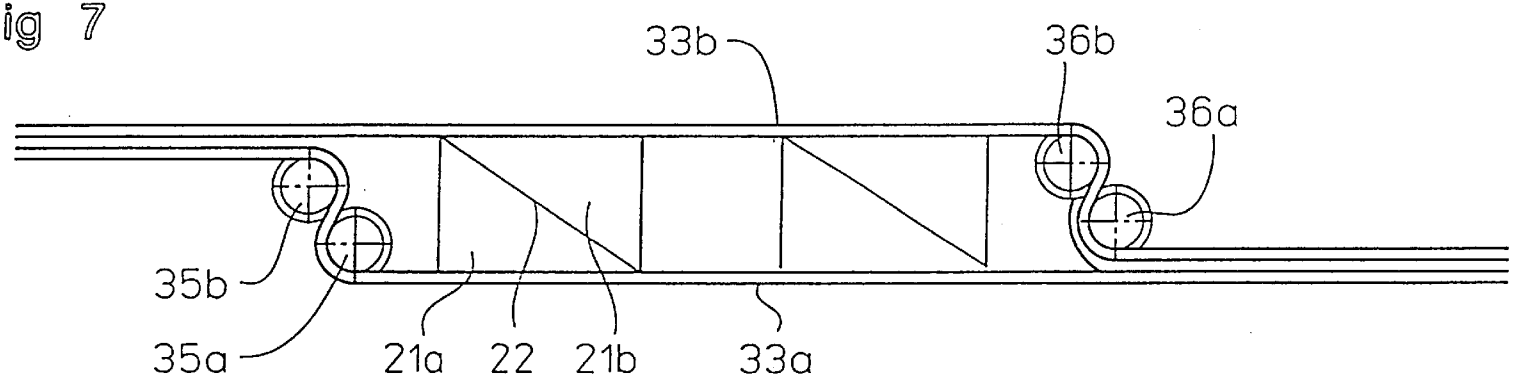

| | |
|---|---|
| FIG. 1 | is a perspective view of a portion of a web according to the present invention, with the retainer devices of the web designed as material thickened portions; |
| FIG. 1a | is a section taken along the line 1a–1a in FIG. 1; |
| FIG. 1b | is a section taken along the line 1b–1b in FIG. 1; |
| FIG. 1c | is a section taken along the line 1c–1c in FIG. 1; |
| FIG. 2 | is a perspective view of a portion of a web according to the present invention in which the retainer devices of the web designed are as tunnels; |
| FIG. 2a | is a section taken along the line 2a–2a in FIG. 2; |
| FIG. 2b | is a section taken along the line 2b–2b in FIG. 2; |
| FIG. 2c | is a section taken along the line 2c–2c in FIG. 2; |
| FIG. 3 | is a side elevation of a portion of the web according to FIG. 1 with both walls of the web in abutment against one another; |
| FIGS. 3a–c | are sections taken along the lines 3a–3a, 3b–3b and 3c–3c, respectively, in FIG. 3; |
| FIG. 4 | is a side elevation of a portion of the web according to FIG. 2 with both walls of the web in abutment against one another; |
| FIGS. 4a–c | are sections taken along the lines 4a–4a, 4b–4b and 4c–4c, respectively, in FIG. 4; |
| FIG. 5a | is a section corresponding to the section 1b–1b in FIG. 1 showing an alternative design of the thickened portions of the web; |
| FIG. 5b | is a section corresponding to the section 1b–1b in FIG. 1, showing a third retainer device disposed along the web; |
| FIG. 5c | is a section corresponding to the section 1b–1b in FIG. 1, with a folded-in bottom of the web; |
| FIG. 6 | is a schematic view in perspective of a filling apparatus and a web in position in the filling apparatus; |
| FIG. 6a | is a section taken along the line 6a–6a in FIG. 6; |
| FIG. 6b | is a section taken along the line 6b–6b in FIG. 6; |
| FIG. 7 | is a side elevation of the filling apparatus and the web according to FIG. 6; and |
| FIG. 8 | is a top plan view of the filling apparatus and the web according to FIG. 6. |

DETAILED DESCRIPTION

FIGS. 1–5 show embodiments of a continuous web 20 of flexible material, generally plastic or similar material. The expression "similar material" is taken to signify any material whatever possessing such properties that a web of the material is suitable for use in practical application of the present invention as described herein. The web displays two opposing walls 21*a,b,* hereinafter also referred to as the first wall 21*a* and second wall 21*b*, and first (lower) and second (upper) edges 22 and 23, respectively, located in the longitudinal direction of the web, which also includes a number of mutually sequentially disposed package blanks or pockets 26. The pockets each have a bottom portion 15 at said lower edge 22 and two connection zones or joints 25, which are transverse in relation to the longitudinal direction of the web and form side closures 25*a,b* of the pockets.

In the Figures, the web is generally shown in embodiments in which the opposing walls 21*a,b* directly merge into one another in that the walls are folded over in the bottom portions 15 of the pockets in order to form the bottom of the pockets. It will be obvious to a skilled reader of this specification that, in other embodiments, both walls of the pockets form (as illustrated in FIG. 5*c*) an inwardly folded bottom or are interconnected with one another, for example by means of a weld joint or seam which also forms the lower edge 22 of the web. Between the joints in two mutually adjacent pockets 26, there is a transverse slit 27 which defines the pockets from one another.

Each respective wall 21*a,b* includes two opposing edge portions 24*a,b* which extend in the longitudinal direction of the web at its above-mentioned upper edge 23. Each one of the edge portions includes continuous retainer means 13*a, b;*43*a,b;*53*a,b* for cooperation with mechanical devices 33*a,b* (cf. FIGS. 6*a* and 6*b*) for guiding the edge portions 24*a,b* on movement of the web 20 into an apparatus 3 for filling material into the pockets 26. In the embodiments illustrated in FIGS. 1, 1*b,* 1*c,* 3, 3*a–c* and 5*a–c,* the retainer means are designed as thickened material portions 13*a, b;*43*a,b,* while in other embodiments, as shown in FIGS. 2, 2*b,* 4, 4*a–c,* they consist of tunnels 53*a,b.*

FIGS. 5*a,b* show one embodiment of the material thickened portions of the web in which the material thickening 43*a* of the one wall 21*a* is provided with a groove 72 oriented in the longitudinal direction of the web, and the material thickened portion 43*b* of the second wall 21*b* is provided with a bead 71 oriented in the longitudinal direction of the web. The bead and the groove form male and female parts which fit tightly into one another and are preferably of a configuration which forms a snap-in connection. FIGS. 5*a,b* also show an embodiment in which the web has been provided with strip-like wall portions 14*a,b* above the thickened portions 43*a,b.*

FIG. 5*b* also shows an embodiment of the web in which a second retainer means 44 is provided in the region of the first edge 22 of the web. The second retainer means is intended to be used for retaining the package formed by the packaging blank in connection with emptying of the package.

FIG. 5*c* shows one embodiment in which the bottom portions 15 of the pockets 20 form a crease (bottom crease) 12 inwardly folded in a direction towards the openings of the pockets.

In its end region located most proximal the retainer means 13*a,b;* 43*a,b;*53*a,b,* the transverse slit 27 merges into a longitudinal slit 29*a* in the first wall 21*a* directed to the right in the Figures, and a longitudinal slit 29*b* in the second wall 21*b* directed to the left. The longitudinal slits are located beneath the retainer means 13*a,b;*43*a,b;* 53*a,b.* The slit 29*a* of the first wall 21*a* is defined by an upper edge 16*a* and a lower edge 17*a,* while the slit 29*b* of the second wall 21*b* is defined by an upper edge 16*b* and a lower edge 17*b.*

Reference numerals 28*a,b* refer to those material portions of the web in which the opposing walls of the web are interconnected with one another for closure of the filled package blanks, for example by weld seams or joints. In certain practical applications, the interconnection of the walls takes place in a region beneath the slits 29*a,b*, while, in other applications, the welding together takes place in the region of the slits 29*a,b.* On welding together in the slits, a complete and tight connection will be achieved because of the fact that, at each slit, the wall which opposes the slit is unbroken (has no slit). A complete and tight welding together is effected close to the second (upper) edge of the web, whereby material consumption is reduced for each package which is filled and closed.

FIGS. 6–8 show one embodiment of a filling apparatus 3 in which a web which includes retainer means 13*a,b;*43*a,b* provided as material thickened portions, are displaced in the direction of the arrow A along the mechanical retainer devices 33*a,b* of the filling apparatus. It will be apparent from the Figure that, on entry into the filling apparatus, the retainer means 13*a,*43*a* are guided, at the first wall of the web 21*a*, by mechanical guide means 35*a,b* to proceed a longer distance than the retainer means 13*b,*43*b* of the second wall 21*b* of the web. At the same time, the retainer means of the web are displaced from one another to a distance at most corresponding to the length of the longitudinal slits 29*a,b*. Hereby, the pockets will be opened. The openings which are formed consist of rectangles, as a rule parallelograms. The angles which are formed are determined by the distance between the mechanical retainer devices of the filling apparatus. At maximum spacing between the retainer means of the web, i.e. a distance substantially corresponding to the length of the longitudinal slits, the openings form right-angled rectangles.

On exit from the filling apparatus, the retainer means 13*b,*43*b* of the second wall 21*b* are guided by mechanical guide members 36*a,b* so as to proceed a longer distance than the retainer means 13*a,*43*a* of the first wall 21*a* of the web. The longer distance the retainer means 13*a,*43*a,*53*a* of the first wall 21*a* are moved on entry into the filling apparatus is compensated for by the shorter distance by which the retainer means of the first wall are displaced on exit. This entails that both walls 21*a,b* of the web after exit of the web from the filling apparatus assume the same relative positions in the longitudinal direction of the web as before entry into the filling apparatus. The desired effect will hereby be attained that the opposing walls of the pockets after exit from the filling apparatus assume positions where they are no longer moved in relation to one another in a longitudinal direction of the web. As a result, on the displacement out of the filling apparatus, the walls 21*a,b* of the web 20 are moved to positions adjacent to one another, i.e. to positions in which a reliable and wholly acceptable closure and seaming of the pockets takes place in that the walls 21*a,b* are connected in the material portions 28*a,b.*

It will be obvious to a person skilled in the art that the size of the openings of the package blanks may simply be adapted to current needs by suitable dimensioning of the web and of the length of the longitudinal slits in the web at the same time as the desired configuration of the openings of the package blanks on supply of contents may simply be regulated by an adjustment of the distance between the retainer devices of the filling apparatus.

A further advantage inherent in the new technique as herein disclosed is that, in the embodiment of the filling apparatus shown on the Drawings, only one of the retainer devices of the filling apparatus need be moved to a new position when adapting the distance between the retainer devices in connection with switching to a web of other dimensions than those which the filling apparatus is set to handle.

In FIGS. 6*a,b*, the mechanical retainer devices 33*a,b* of the filling apparatus are shown as suspension devices for the retainer means 13*a,b*; 43*a,b* of the web when these are formed as material thickened portions. The mechanical retainer devices 33*a,b* are, in the region where the pockets 26 are supplied with contents, each provided with their channel 31*a,b*. Each respective channel is dimensioned to accommodate the material thickened portion 13*a,b* of one of the walls. Each one of the channels 31*a,b* is provided with a longitudinal gap 34*a,b* of a minimum extent in the transverse direction which is less than the width of the thickened portion 13*a,b* of each respective web wall 21*a,b*. As a rule, the mechanical devices are oriented such that the web depends down through the gaps 34*a,b* of the mechanical devices 33*a,b* during displacement therealong. Other orientation of the mechanical devices and of the web are employed in other applications of the present invention.

In the foregoing description, use has occasionally been made of the designations upper, lower, right, left, etc. These designations have been employed merely to facilitate presentation of the invention. It will, however, be obvious to a person skilled in the art that the technique described above generally permits any optional orientation of the web in space.

The above-detailed description has referred to but a limited number of embodiments of the present invention, but a person skilled in the art will readily perceive that the present invention accommodates a large number of embodiments without departing from the spirit and scope of the appended claims.

We claim:

1. A continuous, flexible web (2) comprising a first wall (21*a*), a second wall (21*b*) facing the first wall and longitudinal first and second edges (22, 23), said web forming mutually sequentially disposed package blanks (26) each with a bottom portion (15) at said first edge (22) and with two connection zones (25) which are transversely directed in relation to a longitudinal direction of the web and which form first and second side closures (25*a, b*) for the package blanks, said web having transverse slits (27) disposed between the side closures (25*a, b*) in two mutually adjacent package blanks (26), each respective wall (21*a, b*) comprising two opposing edge portions (24*a, b*) which extend in the longitudinal direction of the web at its said second edge (23), each edge portion including continuous retainer means (13*a, b*; 43*a, b;* 53*a, b*) for cooperation with mechanical devices (33*a, b*) for guiding the edge portions (24*a, b*) on displacement of the web into an apparatus (3) for supplying material to the package blanks (26), and wherein longitudinal slits (29*a, b*) are provided on either side of said transverse slits (27) between the package blanks (26) and said retainer means (43*a, b*), each of said first and second walls (21*a,* 21*b*) of each package blank (26) being provided with a single one of said longitudinal slits (29*a,* 29*b,* respectively); the longitudinal slit (29*a*) in the first wall (21*a*) being located adjacent to the one side closure (25*a*) of the package blank; and the longitudinal slit (29*b*) in the second wall (21*b*) being located adjacent to the second side closure (25*b*) of the package blank, the single longitudinal slits in said first and second walls each extends from its respective said transverse slit in one direction only and does not extend across said transverse slit.

2. The web as claimed in claim 1, wherein the retainer means comprises tunnels (53*a,b*).

3. The web as claimed in claim 2, wherein each package blank (26) is, in the region of the first edge (22) of the web, provided with a second retainer means (44) for cooperation with a mechanical device for at least temporary fixing of the second retainer means.

4. The web as claimed in claim 1, wherein the retainer means comprises thickened material portions (13*a,b*; 43*a,b*).

5. The web as claimed in claim 4, wherein one of the thickened portions (43*b*) is provided with a bead (71) facing towards the other thickened portion (43*a*); the second thickened portion (43*a*) being provided with a groove (72) facing towards the bead; the bead and the groove being dimensioned, on insertion of the bead into the groove, to form a snap-in function for interconnection of both of the thickened portions.

6. The web as claimed in claim 5, wherein each package blank (26) is, in the region of the first edge (22) of the web, provided with a second retainer means (44) for cooperation with a mechanical device for at least temporary fixing of the retainer means.

7. The web as claimed in claim 4, wherein package blank (26) is, in the region of the first edge (22) of the web, provided with a second retainer means (44) for cooperation with a mechanical device for at least temporary fixing of the second retainer means.

8. The web as claimed in claim 1, wherein each package blank (26) is, in the region of the first edge (22) of the web, provided with a second retainer means (44) for cooperation with a mechanical device for at least temporary fixing of the second retainer means.

9. The web as claimed in claim 1, wherein said longitudinal slits in said first and second walls extend in opposite directions from each respective transverse slit.

10. The web as claimed in claim 9, wherein said longitudinal slits in the first and second walls of each package blank extend from the side closures of said blank towards one another.

* * * * *